US011761310B2

(12) United States Patent
Windegaard et al.

(10) Patent No.: US 11,761,310 B2
(45) Date of Patent: Sep. 19, 2023

(54) GRAVEL PACK SLEEVE

(71) Applicant: Schlumberger Technology Corporation, Sugar Land, TX (US)

(72) Inventors: Eirik Windegaard, Randaberg (NO); Haavard Molde, Stavanger (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 289 days.

(21) Appl. No.: 17/312,414

(22) PCT Filed: Dec. 9, 2019

(86) PCT No.: PCT/US2019/065251

§ 371 (c)(1),
(2) Date: Jun. 10, 2021

(87) PCT Pub. No.: WO2020/123391

PCT Pub. Date: Jun. 18, 2020

(65) Prior Publication Data

US 2022/0025741 A1 Jan. 27, 2022

Related U.S. Application Data

(60) Provisional application No. 62/779,429, filed on Dec. 13, 2018.

(51) Int. Cl.

| | |
|---|---|
| ***E21B 43/08*** | (2006.01) |
| ***E21B 43/04*** | (2006.01) |
| ***E21B 43/10*** | (2006.01) |

(52) U.S. Cl.
CPC ..... *E21B 43/04* (2013.01); *E21B 43/10* (2013.01)

(58) Field of Classification Search
CPC ..... E21B 43/04; E21B 43/10
See application file for complete search history.

(56) References Cited

U.S. PATENT DOCUMENTS

| | | | | |
|---|---|---|---|---|
| 4,296,807 | A * | 10/1981 | Hendrickson | E21B 33/1243 166/334.4 |
| 5,497,840 | A * | 3/1996 | Hudson | E21B 7/20 166/278 |
| 5,609,204 | A | 3/1997 | Rebardi et al. | |
| 7,866,708 | B2 | 1/2011 | Johnson et al. | |
| 8,490,697 | B2 | 7/2013 | Garcia et al. | |
| 10,060,231 | B2 * | 8/2018 | Fisher | E21B 43/086 |
| 2005/0200127 | A1 * | 9/2005 | Johnson | E21B 17/18 285/333 |

(Continued)

FOREIGN PATENT DOCUMENTS

WO 2009061542 A1 5/2009

OTHER PUBLICATIONS

International Search Report and Written Opinion issued in the PCT Application PCT/US2019/065251, dated Apr. 9, 2020 (14 pages).

(Continued)

*Primary Examiner* — Taras P Bemko
(74) *Attorney, Agent, or Firm* — Jeffrey D. Frantz

(57) ABSTRACT

A system includes a tubular member, a sleeve disposed inside the tubular member, and a service tool. A dimension of the sleeve bridges a gap between an outer diameter of the service tool and an inner diameter of the tubular member.

15 Claims, 2 Drawing Sheets

(56) References Cited

U.S. PATENT DOCUMENTS

| | | | | |
|---|---|---|---|---|
| 2013/0248179 | A1 | 9/2013 | Yeh et al. | |
| 2016/0273287 | A1* | 9/2016 | Scott | E21B 34/14 |
| 2017/0138158 | A1* | 5/2017 | Bourgneuf | E21B 33/12 |
| 2017/0342810 | A1* | 11/2017 | Richards | E21B 43/08 |
| 2019/0292885 | A1* | 9/2019 | Penno | E21B 43/04 |

OTHER PUBLICATIONS

International Preliminary Report on Patentability issued PCT Application PCT/US2019/065251, dated Jun. 24, 2021, 9 pages.

* cited by examiner

GRAVEL PACK SLEEVE

CROSS-REFERENCE TO RELATED APPLICATION

The present document is based on and claims priority to U.S. Provisional Application Ser. No. 62/779,429, filed Dec. 13, 2018, which is incorporated herein by reference in its entirety.

BACKGROUND

Hydrocarbon fluids such as oil and natural gas are obtained from a subterranean geologic formation, referred to as a reservoir, by drilling a wellbore that penetrates the hydrocarbon-bearing formation. Once the wellbore is drilled, various forms of well completion components may be installed to control and enhance the efficiency of producing the various fluids from the reservoir.

Oil and gas companies often perform a gravel pack operation during the completion phase of oil wells. Generally, a completion assembly is positioned in a wellbore and a service tool is used in cooperation with the completion assembly to create a gravel pack in the annulus between the completion assembly and the wellbore wall. The gravel pack is formed by pumping a gravel slurry, which includes a plurality of gravel particles dispersed in a carrier fluid, from the surface down through the annulus. When the gravel slurry reaches the screen in the completion assembly, the carrier fluid flows radially-inward through the screen, leaving the gravel particles in the annulus to form a "gravel pack" around the screen. The carrier fluid then flows into the base pipe and up to the surface. The gravel pack helps filter out sand and other particulates from a desired production fluid entering the wellbore.

For gravel pack operations, more casing and liner sizes exist than gravel pack service tool sizes. Accordingly, there is a need for gravel packing other sizes of liner and casing than what the gravel pack service tool was originally designed for.

SUMMARY

According one or more embodiments of the present disclosure, a system includes a tubular member, a sleeve disposed inside the tubular member, and a service tool. In one or more embodiments, a dimension of the sleeve bridges a gap between an outer diameter of the service tool and an inner diameter of the tubular member.

According to one or more embodiments of the present disclosure, a method includes deploying a tubular member in a wellbore, the tubular member including at least one port; deploying a sleeve in the wellbore such that the sleeve is disposed inside the tubular member adjacent the at least one port; deploying a service tool assembly in the wellbore, the service tool assembly comprising a service tool and a crossover having at least one crossover port; and performing an operation, wherein a treatment fluid flows through the at least one crossover port of the service tool, through the at least one port of the tubular member, and into an annulus between the tubular member and a wall of the wellbore.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies.

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

One or more embodiments of the present disclosure include a gravel pack sleeve that bridges the gap between an outer diameter of a gravel pack service tool and an internal diameter of a host casing, liner, tubing, or any other equipment. Accordingly, one or more embodiments of the present disclosure provides a solution for gravel packing other sizes of liner and casing than what the service tool was originally designed for.

Figure 1:
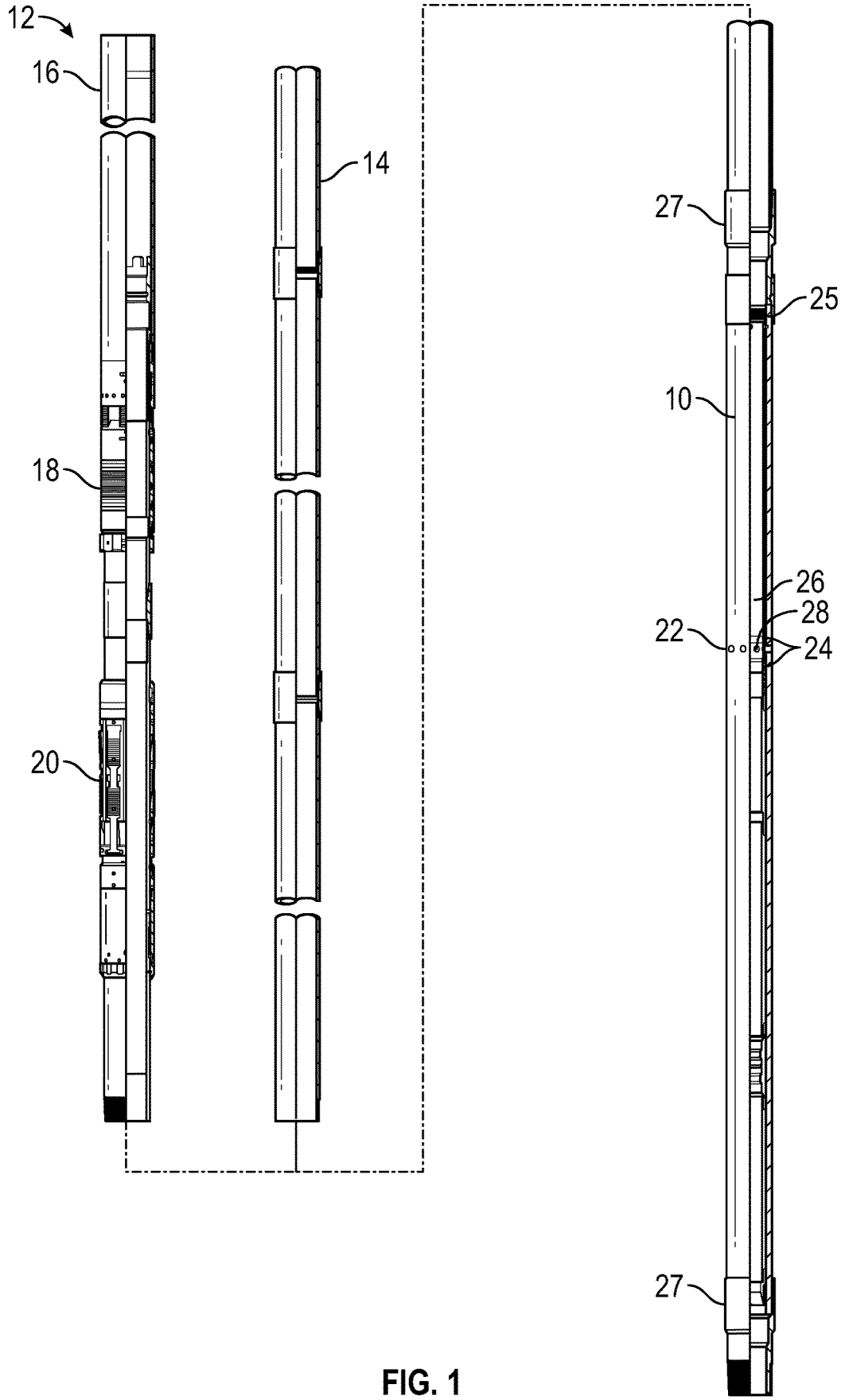
FIG. 1 shows a completion assembly according to one or more embodiments of the present disclosure.

Referring generally to FIG. 1, a tubular member 10, which may be host casing, a liner, or other tubing, is connected to a hanger system 12 or continuous casing/tubing 14 in a completion assembly. That is, according to one or more embodiments of the present disclosure, the tubular member 10 may be directly connected to the hanger system 12, or directly connected to continuous casing/tubing 14, which may include one or more casing joints, for example, the continuous casing/tubing 14 being connected to the hanger system 12. As shown in FIG. 1, the hanger system 12 may include a tieback receptacle 16, liner top packer 18, and a liner hanger 20, for example. According to one or more embodiments of the present disclosure, the tubular member 10 may also include at least one port 22 for gravel packing.

In one or more embodiments of the present disclosure, a service tool assembly (not shown due to placement of gravel pack sleeve 26 described below), which may include an upper section coupled to a service tool through a crossover, may be deployed downhole while engaged with the tubular member 10 of the completion assembly. An appropriate conveyance, such as a drill string, work string, or other tubing, can be used to convey the completion assembly and the service tool assembly downhole in a single trip. Alternatively, the service tool assembly may be separately deployed, after the completion assembly has already been deployed and secured downhole.

In one or more embodiments of the present disclosure, the crossover of the service tool assembly includes one or more crossover ports, which are aligned with corresponding ports 22 of the tubular member 10 to facilitate gravel packing. Once the one or more crossover ports are aligned with corresponding ports 22 of the tubular member 10, the annulus surrounding the tubular member 10 of the completion assembly may be gravel packed. In one or more embodiments of the present disclosure, a treatment fluid, such as a gravel slurry including a mixture of a carrier fluid and gravel, can flow through the service tool through the aligned crossover and tubular member ports and into the annulus between the completion assembly and the wellbore wall. The carrier fluid of the gravel slurry can flow back into the service tool leaving the gravel disposed in the annulus. The gravel forms a permeable mass or "pack" between the completion assembly, which may include one or more screens, and the wellbore wall. The gravel pack allows production fluids to flow therethrough while substantially blocking the flow of any particulate material, e.g., sand.

Still referring to FIG. 1, according to one or more embodiments of the present disclosure, the tubular member 10, e.g., host casing, a liner, or other tubing, accommodates a plurality of seals 24. Moreover, a gravel pack sleeve 26 is placed inside the host casing 10, liner tubing, or other equipment to allow gravel packing with a service tool of a smaller outer diameter than the internal diameter of the host casing 10, liner, tubing, or other equipment. In this way, the gravel pack sleeve 26 bridges a gap between the service tool outer diameter and the internal diameter host casing 10, liner, tubing, or other equipment, and one or more ports 28 of the gravel pack sleeve 26 may be aligned with one or more corresponding ports of the service tool and one or more corresponding ports 22 of the tubular member 10. Internal dimensions and/or profiles of the gravel pack sleeve 26 are made to fit the particular gravel pack system, including the gravel pack service tool, according to one or more embodiments of the disclosure. In one or more embodiments of the present disclosure, the plurality of seals 24 is disposed between the tubular member 10 and the gravel pack sleeve 26. That is, the gravel pack sleeve 26 according to one or more embodiments of the present disclosure accommodates a plurality of outside seals 24. These seals 24 between the tubular member 10 and the gravel pack sleeve 26, and outside the gravel pack sleeve 26, divert flow through the at least one port 22 in the tubular member 10 in one or more embodiments of the present disclosure.

Figure 2:
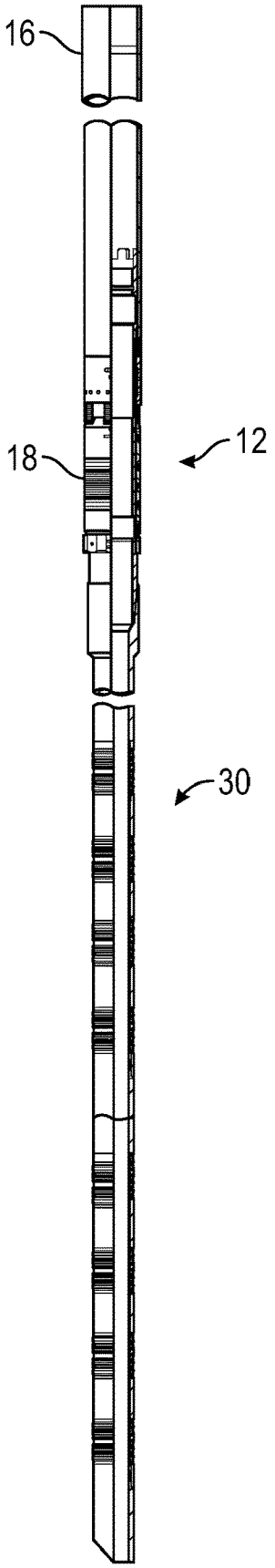
FIG. 2 shows a seal system according to one or more embodiments of the present disclosure.

Still referring to FIG. 1, the completion assembly may also include a mechanism 25 for securing and running the gravel pack sleeve 26. Moreover, in embodiments where the gravel pack sleeve 26 is retrievable to the surface, the completion assembly may include a mechanism 25 for pulling the gravel pack sleeve 26 from inside the tubular member 10, for example. The mechanism 25 for securing and running the gravel pack sleeve 26 and the mechanism 25 for retrieving the gravel pack sleeve 26 may be the same mechanism or different mechanisms according to one or more embodiments of the present disclosure. Retrieving the gravel pack sleeve 26 to the surface leaves a full bore open internal diameter through the casing, liner, or tubing. According to one or more embodiments, after potential retrieval of the sleeve 26, the ports 22 in the tubular member 10 may be sealed off by a suitable technique, e.g., running a hanger system 12 or packer system 18 with a seal system 30, which may include a seal stinger, a casing patch, or any kind of straddle, as shown in FIG. 2, for example. In one or more embodiments of the present disclosure, the straddle may also be run inside the gravel pack sleeve 26 itself. In one or more embodiments of the present disclosure, the seal system 30 to seal off ports 22 in the tubular member 10 may be a tieback seal assembly, for example.

In other embodiments of the present disclosure, the gravel pack sleeve 26 may be installed permanently within the completion assembly.

According to one or more embodiments of the present disclosure, an attachment point may be disposed between the gravel pack sleeve 26 and the tubular member 10, e.g., host casing, a liner, or other tubing, or between the gravel pack sleeve 26 and the gravel pack service tool. For example, the gravel pack sleeve 26 may be attached to a polished bore receptacle (PBR) of the tubular member 10 using a plurality of pins or another type of fastener in accordance with one or more embodiments of the present disclosure. The attachment point according to one or more embodiments of the present disclosure advantageously prevents unintentional movement of the gravel pack sleeve 26 during running and/or gravel pack operations.

According to one or more embodiments of the present disclosure, the completion assembly may include one or more additional crossovers 27 to facilitate the connection of two assembly components having different thread types or sizes, for example.

In one or more embodiments of the present disclosure, the gravel pack sleeve 26 can be run together with the tubular member 10, e.g., host casing, a liner, tubing, or other equipment, or the gravel pack sleeve 26 can be installed at a later stage, either on a dedicated run, or combined with other runs in the well.

Advantageously, the gravel pack sleeve 26 according to one or more embodiments of the present disclosure bridges the gap between the outer diameter of the gravel pack service tool and the inner diameter of the tubular member 10 of the completion assembly, e.g., host casing, a liner, tubing, or other equipment. As such, gravel packing with a standard service tool having a smaller diameter than the internal diameter of the tubular member 10 may be greatly facilitated.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a tubular member comprising a tubular member port;

a sleeve disposed inside the tubular member and comprising a sleeve port aligned with the tubular member port; and a service tool disposed at least partially within the sleeve and operable to flow a treatment fluid into an annulus surrounding the tubular member through the sleeve port and the tubular member port, wherein a dimension of the sleeve bridges a gap between an outer diameter of the service tool and an inner diameter of the tubular member.

2. The system of claim 1, wherein the tubular member is a casing.

3. The system of claim 1, wherein the tubular member is a liner.

4. The system of claim 1, further comprising a plurality of seals disposed between the sleeve and the tubular member, wherein at least one of the plurality of seals is positioned uphole of the tubular member port and the sleeve port and at least one seal of the plurality of seals is positioned downhole of the tubular member port and the sleeve port.

5. The system of claim 1, further comprising an attachment point between the sleeve and the tubular member to prevent unintentional movement of the sleeve.

6. The system of claim 1, further comprising an attachment point between the sleeve and the service tool to prevent unintentional movement of the sleeve.

7. The system of claim 1, wherein the sleeve is retrievable to a surface.

8. The system of claim 1, wherein the sleeve is non-retrievable.

9. A method, comprising:

deploying a tubular member in a wellbore, the tubular member comprising a tubular member port;

deploying a sleeve in the wellbore such that the sleeve is disposed inside the tubular member adjacent the tubular member port, the sleeve comprising a sleeve port aligned with the tubular member port;

deploying a service tool assembly in the wellbore, the service tool assembly disposed at least partially within the sleeve and comprising a service tool and a crossover having at least one crossover port; and performing an operation, wherein a treatment fluid flows through the at least one crossover port of the service tool, through the sleeve port, through the tubular member port, and into an annulus between the tubular member and a wall of the wellbore, wherein a dimension of the sleeve bridges a gap between an outer diameter of the service tool and an inner diameter of the tubular member.

10. The method of claim 9, wherein the treatment fluid comprises a gravel slurry.

11. The method of claim 9, wherein the tubular member is a casing.

12. The method of claim 9, wherein the tubular member is a liner.

13. The method of claim 9, wherein the sleeve is deployed simultaneously with the tubular member.

14. The method of claim 9, further comprising retrieving the sleeve after performing the operation.

15. The method of claim 14, further comprising sealing off the tubular member port after retrieval of the sleeve.

* * * * *